US009157634B2

(12) United States Patent
Mencel et al.

(10) Patent No.: US 9,157,634 B2
(45) Date of Patent: Oct. 13, 2015

(54) INDIRECT FIRED HEATER WITH INLINE FUEL HEATER

(75) Inventors: David Mencel, Menomonee Falls, WI (US); Joe Grinwald, Hartford, WI (US); Jason Fu, Spring Lake, MI (US); Brandon Nickolas, Muskegon, MI (US)

(73) Assignee: Wacker Neuson Production Americas, LLC, Menomonee Falls, WI (US)

( * ) Notice: Subject to any disclaimer, the term of this patent is extended or adjusted under 35 U.S.C. 154(b) by 321 days.

(21) Appl. No.: 13/221,366

(22) Filed: Aug. 30, 2011

(65) Prior Publication Data

US 2013/0052595 A1 Feb. 28, 2013

(51) Int. Cl.

| | |
|---|---|
| ***F23N 1/00*** | (2006.01) |
| ***F23K 5/04*** | (2006.01) |
| ***F24H 1/06*** | (2006.01) |
| ***F24H 3/08*** | (2006.01) |
| *F02M 31/00* | (2006.01) |
| *F02M 31/12* | (2006.01) |
| *F02M 31/02* | (2006.01) |

(Continued)

(52) U.S. Cl.

CPC .. *F23K 5/04* (2013.01); *F24H 1/06* (2013.01); *F24H 3/087* (2013.01); *F02M 31/00* (2013.01); *F02M 31/02* (2013.01); *F02M 31/12* (2013.01); *F02M 31/125* (2013.01); *F23K 5/20* (2013.01); *F23K 2301/201* (2013.01); *F23K 2301/202* (2013.01); *F23K 2301/204* (2013.01); *F23K 2301/206* (2013.01)

(58) Field of Classification Search

CPC ..... F02M 31/00; F02M 31/02; F02M 31/12; F02M 31/125; F23K 5/20

USPC ..... 126/116 R, 117 R; 431/11, 12, 207, 208, 431/3, 121

See application file for complete search history.

(56) References Cited

U.S. PATENT DOCUMENTS 2,635,922 A 4/1953 Kolstee et al.
4,392,810 A * 7/1983 Bears et al. ..... 431/37

(Continued)

FOREIGN PATENT DOCUMENTS

JP 2003293886 A * 10/2003

OTHER PUBLICATIONS

Jarrett, Von H. 'Bleeding Air from Diesel Fuel Lines and Filters'. Utah State University Cooperative Extension, Feb. 2002, [retrieved on Oct. 9, 2013]. Retrieved from the Internet: <URL: http://extension.usu.edu/files/publications/factsheet/FM-01.pdf>.*

(Continued)

*Primary Examiner* — Kenneth Rinehart
*Assistant Examiner* — Gajanan M Prabhu
(74) *Attorney, Agent, or Firm* — Boyle Fredrickson, S.C.

(57) ABSTRACT

A heater and a method of its use are configured for use at cold operating temperatures. The heater has a supply line for transporting a volume of fuel between a fuel tank and burner. An inline heater is supplied in a supply line for the burner. The heater also has a return line that normally returns unused fuel from the burner to the heater, hence reducing the volume of fuel that needs to be heated by the heater and reducing system power requirements. The heater may be thermostatically controlled to maintain the temperature of the heated fuel to a value that is at or above a temperature required for good fuel atomization but below a flashpoint of the fuel. A valve is provided in the return line to permit diversion of the returned fuel to the fuel tank during a purge operation at initial startup.

17 Claims, 4 Drawing Sheets

(51) Int. Cl.
*F02M 31/125* (2006.01)
*F23K 5/20* (2006.01)

(56) References Cited

U.S. PATENT DOCUMENTS 4,397,633 A * 8/1983 Rowlee ..... 431/215
4,424,422 A * 1/1984 Bell et al. ..... 219/205
4,432,329 A * 2/1984 Redele ..... 123/557
4,440,138 A 4/1984 Smith
4,447,706 A * 5/1984 Eder et al. ..... 392/473
4,454,851 A 6/1984 Bourbonnaud et al.
4,850,327 A 7/1989 Fayard
4,892,996 A 1/1990 Mertes
5,085,198 A * 2/1992 Bartlett et al. ..... 123/510
5,145,328 A * 9/1992 Harwath ..... 417/299
5,149,260 A * 9/1992 Foust ..... 431/11
5,205,250 A * 4/1993 Easterly et al. ..... 123/142.5 R
5,259,871 A 11/1993 Tigerholm
5,832,902 A * 11/1998 Davis et al. ..... 123/514
5,879,149 A * 3/1999 Briggs et al. ..... 431/208
5,896,846 A * 4/1999 Bauer et al. ..... 123/510
6,350,116 B1 * 2/2002 Herrmann ..... 431/208
6,839,508 B2 1/2005 Biess et al.
6,964,267 B2 * 11/2005 Jin ..... 123/514
7,137,402 B2 11/2006 Tigerholm
8,186,332 B2 * 5/2012 Sturgess ..... 123/514
2011/0192376 A1 * 8/2011 Graspeuntner et al. ..... 123/456
2012/0279484 A1 * 11/2012 Lange ..... 126/110 R

OTHER PUBLICATIONS

Li, De-gang; Zhen, Huang; Xingcai, Lu; Wu-gao, Zhang; Jian-guang, Yang. 'Physico-chemical properties of ethanol-diesel blend fuel and its effect on performance and emissions of diesel engines'. Renewable Energy, 2005, vol. 30 pp. 967-976. Science Direct [online].*
Tigerloop® Brochure.

* cited by examiner

INDIRECT FIRED HEATER WITH INLINE FUEL HEATER

BACKGROUND OF THE INVENTION

1. Field of the Invention

The invention relates generally to fuel burning heaters, more particularly, relates to a fuel burning heater having an inline heater for heating fuel that is bound for the burner. The invention additionally relates to a method of operating such a machine.

2. Discussion of the Related Art

Performing construction work in cold weather climates faces many challenges that are not confronted in warmer climates. In the context of excavation and earth-moving, frozen soil, as is typically confronted in arctic environments, requires substantially more energy, time and resources to move and manipulate. Also, the curing of concrete and other paving materials may be negatively impacted by such extreme cold temperature as required water evaporation and drying are particularly challenging when the liquid components freeze prior to evaporation.

These difficulties can be mitigated through the use of heaters to warm the work site area. One commonly used type of heater is a so-called indirect fired (IDF) heater that heats air and directs the hot-air to the area to be heated by blowing the air through large hoses. The air is heated by a burner that may be fueled by any of a variety of fuels including diesel fuel, kerosene, natural gas, or propane. Heaters that burn a liquid fuel, such as diesel fuel, typically use an atomizing burner supplied with the liquid fuel from a fuel tank via a pump. Atomizing burners operate by pressurizing a fuel oil and forcing it through a nozzle. The nozzle causes the fuel oil to atomize into fine droplets that are readily burned. The atomized fuel is exposed to an electric arc to begin the combustion reaction. When the reaction has stabilized, it is self-sustaining, and the electrode is no longer needed to maintain a flame. The fuel may be supplied in either a "one-pipe system", in which a pump is sized to deliver only as much fuel to the burner as is needed at any given time, or a "two-pipe" system in which the pump delivers much more fuel than is typically required for combustion and the unused fuel is recycled back to the fuel tank. As much as 70-90% of the fuel pumped by a two-pipe system may be returned as unused fuel. Two-pipe systems typically are considered to be preferable to one-pipe systems because they are self-purging after an out-of-fuel condition. That is, air trapped in the fuel lines is automatically purged back to the tank as opposed to having to be manually bled from the fuel lines in a one-pipe system.

Most atomizing burners are designed for indoor use at near room temperature conditions. Several are designed to withstand temperatures now lower than 0° C., and no commercially available burner known to the inventors is capable of starting and operating at temperatures of −40° C. without some degree of modification to either the burner or the fuel supply. The limiting factor preventing operation below these temperatures is the fact that fuel viscosity increases as temperature decreases, resulting in the ejection of larger fuel droplets from the burner's nozzles at low temperatures. At low temperatures of on the order of −20° C. and lower, the larger atomized droplets are difficult to ignite and may not ignite at all. Even if ignition is established, the burner will run with excessive smoke because of ineffective precombustion mixing of the fuel and air.

After-market heaters are available for heating fuel as it is being ejected from the burner's nozzle, but such heaters are minimally effective, even for start up, at extremely low temperatures of on the order of −30° C. Even if these small heaters are effective at improving burner start-up, they are insufficient for maintaining a stable flame over prolonged use. Furthermore, installation of the after-market inline heater requires modification to the heater, and may compromise manufacturer warranties.

In addition, at extremely low temperatures, such fuel may form a solid wax precipitate which can clog both the fuel filter and the burner nozzle. Nozzle heaters are completely ineffective at preventing the formation of such a precipitate in a fuel filter.

Various tank-based or inline heaters have been proposed in an effort to alleviate these problems, but all such heaters have disadvantages. Some are supplied with energy with heat from the burner and, as such, are completely ineffective at start-up when the heater's components are at or near ambient temperature and heating is most critical. Other, electrically powered heaters, require so much energy to operate that they dramatically increase the electrical power draw of the heater.

Despite these prior attempts to design a heater for use in cold weather climates, there remains need for improvement. In light of the foregoing, a heater configured to recirculate and effectively pre-warm fuel is desired.

SUMMARY OF THE INVENTION

One or more of the above-identified needs are met by providing a fuel burning heater having an inline fuel heater and a plumbing system for recirculating warmed fuel. The heater is ideally suited for use with air heaters, but is usable with other devices that require burning fuel in cold weather climates.

In accordance with a first aspect of the invention, a heater is provided, having a supply line for transporting a volume of fuel between a fuel tank and burner. An inline heater for heating the fuel and a fuel filter are located in the supply line between the fuel tank and the burner. The heater also has a return line in fluid communication with the burner and returning a volume of unused fuel from the burner to a valve provided in the return line. The valve is selectively movable between two positions, the first position directing fuel into the fuel tank, and the second position directing fuel into the supply line upstream of or into the inline heater. The recirculation of warmed unused fuel into the supply line at a position upstream of or into the inline heater allows the warmed recirculated fuel to mix with cold fuel drawn from the fuel tank. This results in a pre-heating of the fuel being drawn into the inline heater from the fuel tank, and thereby significantly decreases the electrical burden on the heater.

In one embodiment, the valve is manually operated so as to normally deliver fuel to the heater and to be switchable to deliver fuel back to the tank only, e.g., during a purge operation following an out-of-fuel condition.

The heater may be thermostatically controlled to deliver fuel to the burner at a set, possibly controllable temperature. That temperature preferably is above a temperature at which the fuel is effectively atomized by the burner but below the flash-point of the fuel.

In accordance with yet another aspect of the invention, a method of operating a heater is provided including the steps of directing a first volume of fuel from a fuel tank to an inlet of an inline heater, directing a second volume from a burner to the inline heater via a return line, combining the first and second volumes of fuel in or upstream of the inline heater to form a combined volume of fuel to preheat the first volume of fuel, and heating the combined volume of fuel with an electrical heating element. Additional steps include directing the combined volume of fuel through an outlet of the inline heater to an inlet of the fuel filter, filtering the combined volume of fuel using the fuel filter, directing the combined volume of fuel to the burner, burning a portion of the combined volume of fuel at the burner, directing an unused volume of the combined fuel to a valve in the return line. The valve is switchable to selectively deliver fuel to the inline heater or to the fuel tank, respectively.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

A wide variety of heaters could be constructed in accordance with the invention as defined by the claims. Hence, while the preferred embodiments of the invention will now be described with reference to an indirect-fired air heater, it should be understood that the invention is in no way so limited.

Figure 1:
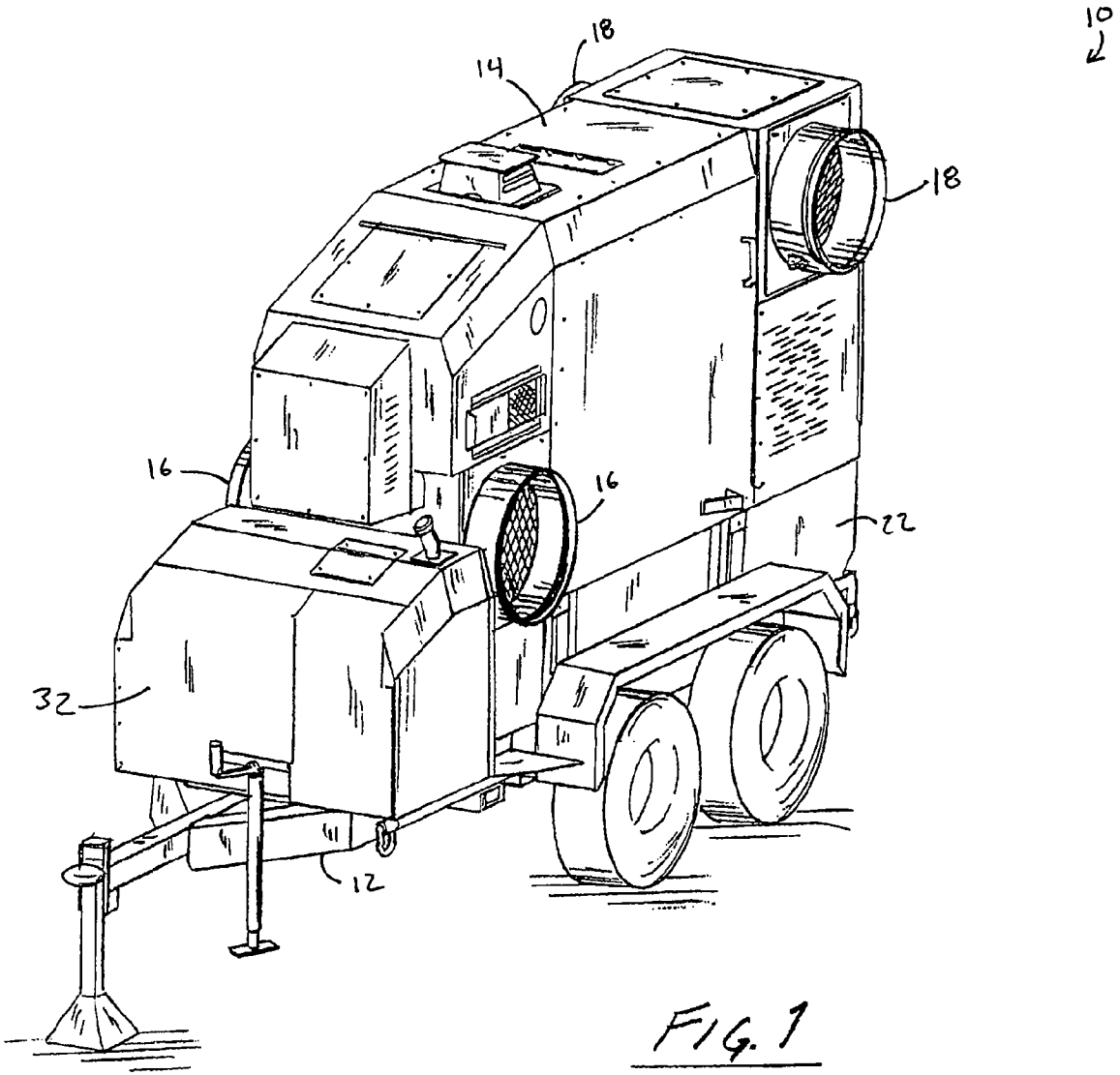
FIG. 1 is a perspective view of an indirect fired air heater constructed in accordance with a preferred embodiment of the invention.
Figure 2:
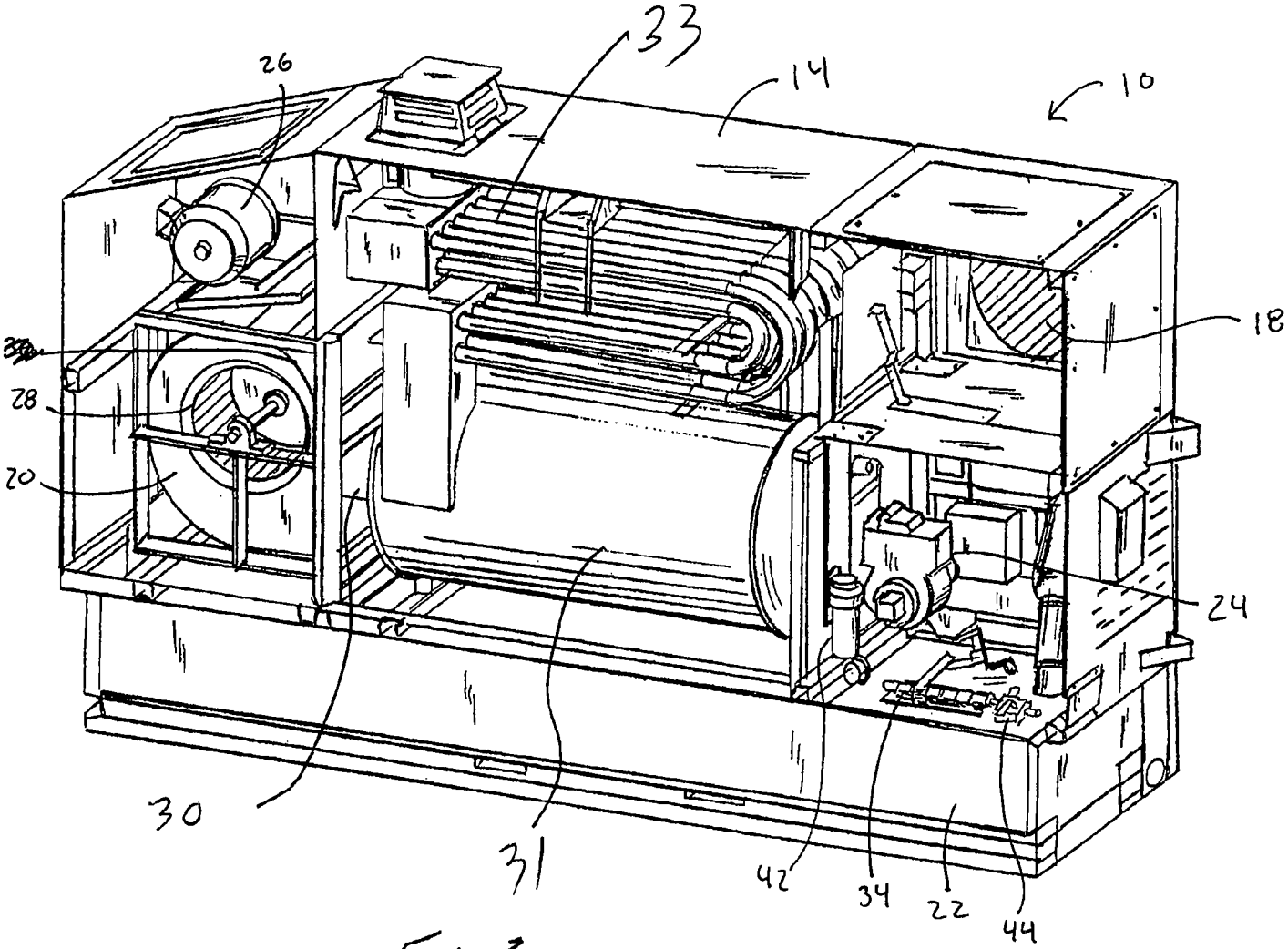
FIG. 2 is a partially cut away perspective view of the interior of the heater of FIG. 1.

FIGS. 1-2 illustrate a perspective view of a heater assembly 10 constructed in accordance with one embodiment of the invention. FIG. 1 shows that the heater assembly 10 can be mounted on a trailer 12 for transport. If a trailer 12 is provided, the heater assembly 10 can remain on the trailer 12 during operation. Alternatively, the heater assembly 10 can be moved to and from a worksite by some other mode of transport and supported directly on the ground during operation.

As can be seen in both FIGS. 1 and 2, the heater assembly 10 includes a casing 14 having air inlet and outlet vents 16, 18 that can be connected to hoses (not shown) to convey air from and to the worksite, respectively. Located within the casing 14 are a blower 20, a fuel tank 22, and an indirect fired heater, i.e. burner 24. The blower 20 is a centrifugal blower powered by a motor 26. The blower 20 has an axial inlet 28 connecting the air supply inlet 16 to a radial outlet 30. A generator 32 is mounted on the trailer 12 in front of the heater assembly 10 for powering electrically-powered components of the heater assembly 10, including the inline heater 34, discussed below. Alternatively, electric power could be supplied to those components via a cable coupled to a main electrical source located at the worksite. It is also conceivable that the electrical components of the heater assembly 10 could be powered by an onboard battery or bank of batteries, but rapid power drains at low temperatures render batteries a less-preferred option, particularly in cold climates.

Figure 4:
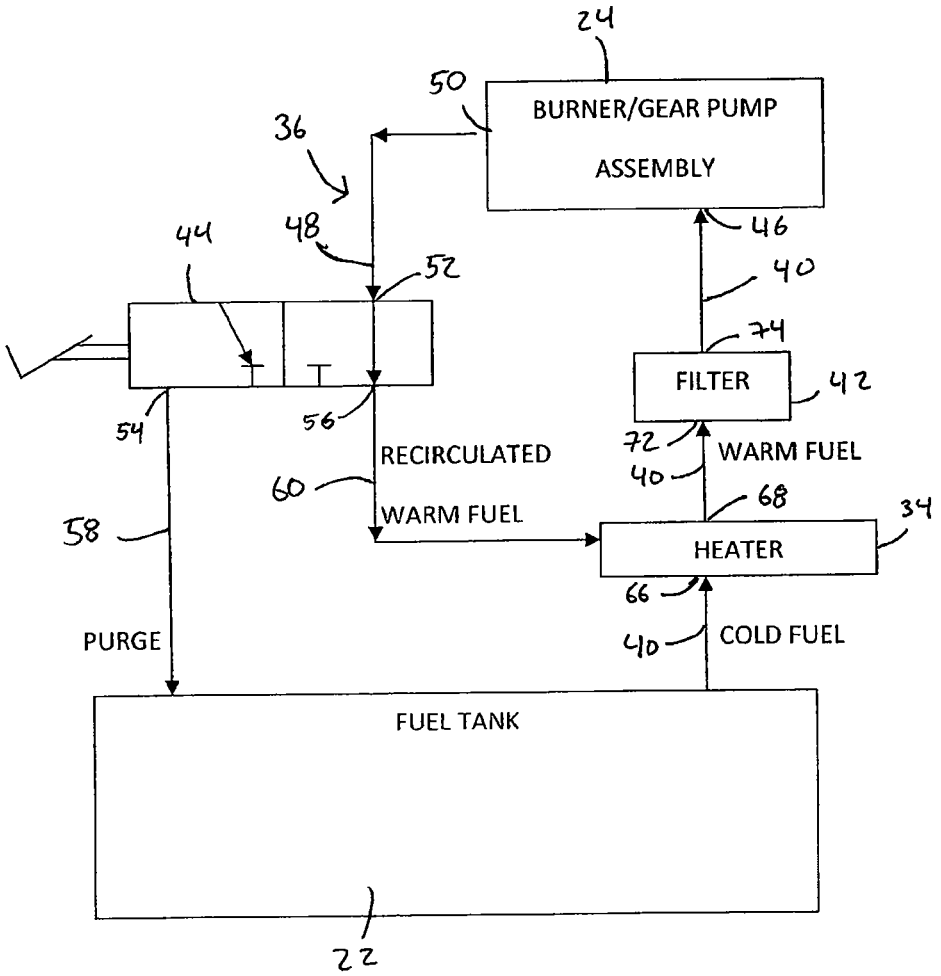
FIG. 4 is a schematic illustration of the heater of FIG. 1.

Referring particularly to FIG. 2, the heater assembly 10 includes a burner 24, a fuel supply assembly 36 that supplies fuel to and from the burner 24, a combustion chamber 31, and a heat exchanger 33. The burner 24 comprises an atomizing burner having an internal gear pump (not shown) and one or more nozzles (also not shown) that open into the combustion chamber 31. The burner 24 heats air in the combustion chamber that indirectly heats air flowing through the heat exchanger 33 from the outlet 30 of the blower 20 to the air supply outlet 18 of the heater assembly 10. Referring to FIG. 4, the burner 24 of this embodiment is part of a two-pipe system having an internal gear pump (not shown), having a fuel inlet 46 coupled to the fuel supply system and unused fuel outlet 50. The burner 24 further comprises an electric ignition source which, when activated, triggers the combustion of the atomized fuel delivered to the nozzle by the gear pump. Once the combustion reaction has been initiated, the electric ignition source is not required to maintain the flame.

Still referring particularly to FIG. 4, the fuel supply system 36 includes a fuel tank 22, a supply line 40, an inline heater 34, a fuel filter 42, and a valve 44. For the sake of visual clarification, FIG. 3 further illustrates these elements without depicting the fuel supply system 36. The supply line 40 connects the fuel tank 22 indirectly to the inlet 46 of the gear pump. The inline heater 34 is located within the supply line 40, between the fuel tank 22 and the burner 24. The fuel filter 42 is also located within the supply line 40 between the inline heater 34 and the burner 24. A return line 48 connects the unused fuel outlet 50 of the gear pump to the valve 44. The valve 44 has a housing 38 (FIG. 3), one inlet 52 for receiving unspent fuel from the burner 24, and first and second outlets 54, 56. The first outlet 54 is coupled to the fuel tank 22 via a first downstream branch 58 of the return line 48 that serves as a purge line. The second outlet 56 is connected to the supply line 40 via a second downstream branch 60 of the return line 48. The second downstream branch 60 of the return line 48 may open into the supply line 40 upstream of the inline heater 34 or into the inline heater 34 itself, preferably at or near an inlet 66 thereof. Since the valve 44 is intended to supply fuel to the second downstream branch 60 of the return line 48 at all times except during a purge operation following an out-of-fuel condition, the valve 44 can be a simple manual operated valve, such as a ball valve.

The inline heater 34 is an electrically powered, thermostatically controlled heater that heats the combined volume of fuel supplied thereby via the supply 40 and return lines 48. Since the vast majority of the fuel being heated (typically on the order of 70% to 80%) is warm recirculated fuel being supplied from the return line 48, the power requirements of the inline heater 34 are dramatically reduced when compared to a heater that heats the entire volume of fuel being withdrawn from the fuel tank in a two-pipe system. Referring again to FIG. 3, the inline heater 34 preferably is formed of an external housing 64 having an inlet 66 and an outlet 68. The housing 64 may be an aluminum tube tapped at both the inlet 66 and outlet 68 ends of the tube. Around the exterior of the housing 64, a layer or multiple layers of thermal insulation may be provided to prevent heat loss, and improve efficiency of the inline heater. Within the housing 64, the inline heater 34 has an electric immersion heater (not shown) formed from electrical heating elements (also not shown) in contact with fuel flowing through the inline heater 34. The heating elements may be of various sizes, as is required to adequately heat the volume of fuel flowing through the inline heater 34.

In one embodiment, the heating element may be a heating pad wrapped along the inner circumference of the inline heater housing 64. A thermostat (not shown), such as a bimetallic thermostat, preferably is provided for controlling the inline heater 34 to heat the fuel to a desired, settable temperature. That temperature preferably is within a range above that required to achieve adequate fuel atomization and below the fuel's flashpoint. In the case of #2 diesel fuel oil (the fuel most commonly used in heaters of the disclosed type), that range preferably is between 0° C. and 65° C. An additional backup, such as a thermally actuated electrical fuse (not shown), may be integrated into the inline heater 34, as to disrupt the flow of electricity to the inline heater 34 at a predetermined temperature beneath the fuel flashpoint.

Figure 3:
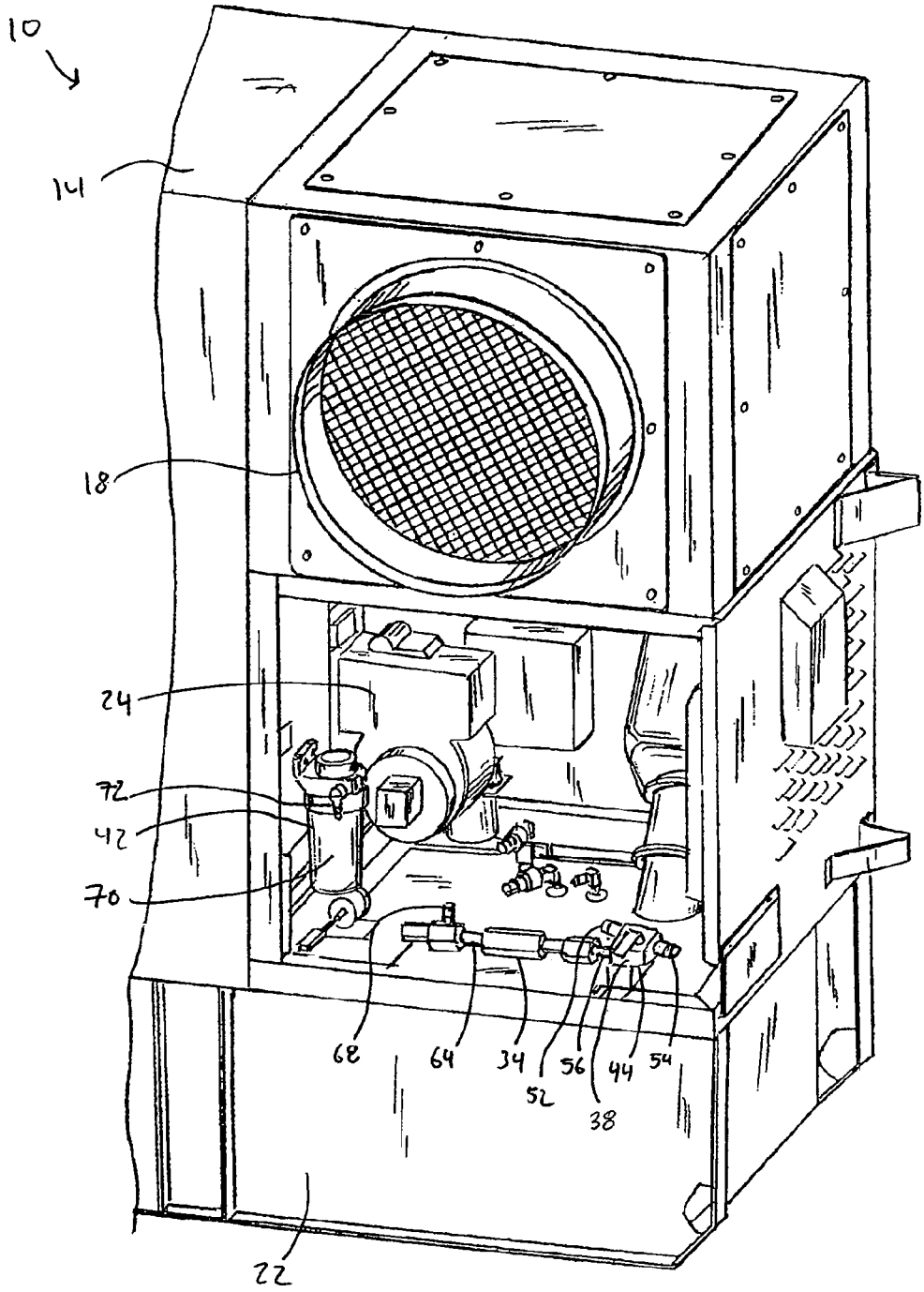
FIG. 3 is another partially cut away perspective view of the interior of the heater of FIG. 1.

Still referring to FIGS. 3 and 4, the fuel filter 42 is located downstream of the inline heater 34, and is in fluid communication with the inline heater outlet 68 by means of the fuel supply line 40. The fuel filter 42 is formed of an external housing 70 having an inlet 72 and an outlet 74. The warmed fuel is received at the inlet 72, and subsequently passes through an internal filter element (not shown), before exiting the outlet 74. Filtration of the fuel is critical for removing undesirable contaminant, which may damage the gear pump or clog the burner 24, unless removed. When using diesel fuel additional contaminants, such as water, may also be separated at the fuel filter.

In operation, as illustrated in FIG. 4, activation of the burner 24 and the gear pump assembly draws fuel from the fuel tank 22 into the supply line 40. The fuel, which in cold weather climates may be at a temperature of approximately −40° C., is then mixed with fuel being returned from the gear pump assembly via the valve 44 and preheated by that fuel to form a combined volume of preheated fuel that may be of a temperature of 0° C. to 40° C. As mentioned above, returned fuel typically will comprise in excess of 50%, and up to 80% or more of the total volume exiting the inline heater 34. The combined volume is warmed to a final temperature of 10° C. to 65° C., by way of passing over the heating element located within the inline heater 34. The warm fuel subsequently travels through the fuel filter 42 where undesirable contaminants are removed. Since the filtered fuel is well-above the temperature above which wax may precipitate in the filter 42, filter clogging is avoided. The filtered fuel then flows to the burner 24 and gear pump assembly. At the burner 24, a fraction of the warm fuel is combusted to heat the surrounding air in the combustion chamber. Because the warm fuel is easily atomized by the burner 24, efficient (i.e. relatively smokeless) combustion without the use of a nozzle heater can be easily achieved. The unspent or non-combusted fuel then travels into the return line 48, where it is received at the valve inlet 52. During normal operation in which the inlet 52 of the valve 44 is connected to the second outlet 56, the returned fuel is delivered to the inline heater 34, via the second downstream branch 60 of the return line 48, where the process is repeated.

Prior to start up, it may be desirable to purge the fuel lines, i.e. fuel supply assembly 36, of the heater assembly 10. This is particularly important following a complete fuel burn off, during which the fuel lines 36 of heater assembly 10 may become filled with air, as opposed to fuel. The fuel lines 36 can be purged by switching the valve 44 to connect the inlet 52 to the first outlet 54, and thereby the purge line 58 and operating the pump for a sufficient period of time to fully purge the air from the fuel supply assembly 36. This purging may be performed either with or without operating the inline heater 34. The valve 44 is then switched back to the second position, in which the valve inlet 52 is in communication with the second outlet 56, and the burner 24 is ignited to heat air.

Tests of the heater assembly 10 according to the embodiment of the present invention have been performed by retrofitting of a Wacker Neuson Cub 700 Mobile heater assembly 10 with the inline heater 34 and recirculation fuel supply assembly 36, as discussed above. The inline heater 34 was connected to an external generator 32 by way of a 115V 60 Hz male plug. At negative thirty degrees Celsius (−30° C.), with the inline heaters 34 not operating, the heater assembly 10 could not be started. However, at negative thirty degrees Celsius (−30° C.), with the inline heaters 34 operating, the heater assembly 10 could both be started and maintain a flame at the burner 24 throughout an overnight operating test. Subsequent testing has also indicated that, at negative forty degrees Celsius (−40° C.), the heater assembly 10 of the present invention was able to start and maintain a flame at the burner 24, after the inline heater 34 was allowed to warm the fuel in the fuel supply assembly 36 for ten minutes.

Many changes and modifications could be made to the invention without departing from the spirit thereof. The scope of these changes and modifications will become apparent from the appended claims.

We claim:

1. A heater comprising:

a fuel tank;

an atomizing burner having a combustion chamber and nozzles that open into the combustion chamber;

a supply line, in fluid communication with the fuel tank and the nozzles of the burner, the supply line transporting a volume of fuel from the tank to the nozzles of the burner;

an inline heater provided in the supply line between the fuel tank and the burner, the inline heater comprising an electric heating element in thermal contact with the volume of fuel and an electrical source operably connected to the heating element;

a fuel filter provided in the supply line between the inline heater and the burner;

a return line in fluid communication with the burner and the fuel tank, the return line returning a volume of unused fuel from the burner; and a valve provided in the return line between the burner and the fuel tank and having an inlet connected to the return line and first and second outlets fluidically coupled to the fuel tank and directly to an inlet of the inline heater, respectively, the valve being switchable to selectively couple the inlet to only the first outlet or the second outlet;

wherein the valve is configured to either purge air from the burner via the first outlet, or return at least half of the volume of fuel transported in the supply line via the second outlet, independent of operating temperature.

2. The heater of claim 1, further comprising a thermostat that controls operation of the inline heater.

3. The heater of claim 1, further comprising a temperature limiter that interrupts the power supply to the inline heater at a predetermined fuel temperature.

4. The heater of claim 3, wherein the predetermined fuel temperature is below a flash point of fuel.

5. The heater of claim 3, wherein the predetermined fuel temperature is above a temperature of paraffin precipitation.

6. The heater of claim 1, wherein the valve has a manual selector to selectively couple the inlet to the first and second outlet, respectively.

7. The heater of claim 1, where the volume of unused fuel is at least approximately two-thirds the volume of fuel transmitted to the burner.

8. The heater of claim 1, wherein the burner further comprises an integrated pump.

9. The heater of claim 1, wherein the inline heater is an air heater, and further comprising a blower and a heat exchanger.

10. A system comprising:

a fuel tank;

an atomizing burner having a combustion chamber and nozzles that open into the combustion chamber;

a supply line in fluid communication with the fuel tank and the nozzles of the burner, the supply line transporting a volume of fuel from the fuel tank to the nozzles;

an inline heater provided in the supply line between the fuel tank and the atomizing burner, the inline heater comprising an electric heating element in thermal contact with the volume of fuel;

a fuel filter provided in the supply line between the inline heater and the atomizing burner;

a return line in fluid communication with the burner and the fuel tank, the return line returning a volume of unused fuel from the atomizing burner; and a manually operated valve provided in the return line between the burner and the fuel tank and having an inlet connected to the return line and first and second outlets fluidically coupled to the fuel tank and directly to an inlet of the inline heater, respectively, the valve being switchable to selectively couple the inlet to only the first outlet or the second outlet;

wherein the valve is configured to either purge air from the burner via the first outlet, or return at least half of the volume of fuel transported in the supply line via the second outlet, independent of operating temperature.

11. A method of preheating a fuel for use in a heater having an atomizing burner, comprising the steps of:

directing a first volume of fuel from a fuel tank to an inlet of an inline heater;

directing a second volume of fuel from the burner to the inline heater via a return line;

combining the first and second volumes of fuel in the inline heater to form a combined volume of fuel;

heating the combined volume of fuel in the inline heater using an electrical heating element;

directing the combined volume of fuel through an outlet in the inline heater to an inlet of a fuel filter;

filtering the combined volume of fuel using the fuel filter;

directing the combined volume of fuel to nozzles that open into a combustion chamber of the burner;

burning a portion of the combined volume of fuel in the combustion chamber;

directing an unused volume of the combined fuel into the return line, the unused volume of the combined fuel comprising at least 50% of the combined volume of fuel;

directing the unused volume of the combined fuel from the return line into an inlet of a valve, the valve being switchable to selectively couple the inlet to only a first outlet or a second outlet, respectively; and wherein the unused volume of the combined fuel is either selectively diverted to the first outlet during a purge of the supply line and return line, or selectively diverted to the second outlet during recirculation of the unused volume of the combined fuel directly to an inlet of the inline heater, independent of operating temperature.

12. The method of claim 11, wherein the unused volume of the combined fuel is selectively diverted to the first outlet during a purge of the supply line and return line and otherwise is supplied to the second outlet.

13. The method of claim 11, further comprising controlling operation of the inline heater to maintain the temperature of the fuel flowing from the inline heater to beneath a predetermined temperature.

14. The method of claim 11, wherein an initial temperature of the first volume of fuel is less than −30 degrees Celsius and the temperature of the combined volume of fuel exiting the inline heater is between 10 and 65 degrees Celsius.

15. The method of claim 11, wherein the unused volume of the combined fuel comprises over 80 percent of the volume of the combined volume of fuel.

16. The heater of claim 1, wherein the heating element is wrapped along an inner circumference of a housing of the inline heater.

17. The system of claim 10, wherein the heating element is wrapped along an inner circumference of a housing of the inline heater.

* * * * *